United States Patent [19]

Rademacher et al.

[11] Patent Number: 4,679,603

[45] Date of Patent: Jul. 14, 1987

[54] FILLING MACHINE FOR FILLING LIQUID UNDER COUNTERPRESSURE

[75] Inventors: Friedrich Rademacher, Kamen-Südkamen; Siegmar Sindermann, Kamen-Heeren; Rolf Süshardt, Waltrop, all of Fed. Rep. of Germany

[73] Assignee: Holstein und Kappert GmbH, Fed. Rep. of Germany

[21] Appl. No.: 811,518

[22] Filed: Dec. 20, 1985

[30] Foreign Application Priority Data

Dec. 20, 1984 [DE] Fed. Rep. of Germany ..... 3446501

[51] Int. Cl.[4] ..... B67C 3/06

[52] U.S. Cl. ..... 141/39; 141/165; 141/302

[58] Field of Search ..... 141/1-12, 141/37-70, 129-191, 311 R, 312, 285-310

[56] References Cited

U.S. PATENT DOCUMENTS 3,779,293 12/1973 Kaiser ..... 141/39

*Primary Examiner*—Houston S. Bell, Jr.

*Attorney, Agent, or Firm*—Toren, McGeady & Associates

[57] ABSTRACT

A filling valve fills liquid from a filling machine vessel into containers. When the filling valve is opened a complete pressure equalization takes place between the vessel and the container to be filled. The container is held in the filling position by a vertically movable centering member. At the end of the filling operation, with the centering member still holding the container, a return gas tube extending into the container can be emptied and the volume of the container above the liquid level can be relieved without any inflow of atmospheric air. Further, the usual expansion below the liquid level is avoided. The centering member along with the filling valve can be lowered into the filling position by a cam disc and a pressure spring and/or assisted by the overpressure within the filling machine vessel. After movement by the cam disc the centering member and filling valve can be pressed against the container opening by the pressure spring and/or the pressure in the vessel. An upwardly extending piston member forming part of the piston-cylinder unit contains the return gas tube and can move independently of the return gas tube for placing the filling valve in the open condition with complete pressure equalization by cooperation with a double lever arm arrangement. When the filling liquid within the container reaches the lower end of the return gas tube, the piston member is lifted by the cam disc and simultaneously there is an increased volume communicating with the container while the centering member is still pressed on the container with the return gas tube being emptied and with the return gas connection to the vessel being cut off whereby the increased volume is exposed to atmospheric pressure.

8 Claims, 2 Drawing Figures

FILLING MACHINE FOR FILLING LIQUID UNDER COUNTERPRESSURE

BACKGROUND OF THE INVENTION

The present invention is directed to a filling machine for supplying liquid under counterpresure into a container and includes a filling machine vessel, a valve support body for filling a valve and a gas return tube and valves in the support body for controlling preliminary air, return air, and a vacuum as well as a piston-cylinder unit for moving the filling valve.

A known filling unit has a bottom portion carrying the container contact pressure seal of the unit which is vertically supported at the lower end of the filling valve head portion and is movable by a piston cylinder unit located opposite to the filling valve head portion. The cylinder is connected to a stressing or pressurizing gas, so that prior to the commencement of the filling operation during the pressurizing of the seal against the bottle by the stressing gas, a contact force must be provided depending upon the pressure to be sealed off. The effective piston surface is selected whereby the desired contact force or pressing force is established.

In this arrangement there is the disadvantage that the piston-cylinder unit is located at the bottom end of the filling valve head portion in the region around the liquid valve in the head portion. Due to this arrangement, the design possiblities are extensively limited. In this known arrangement, the outflow bushing between the liquid valve and the lower end of the filling member must be comparatively long with the result that it acts counter to optimum liquid guidance and is disadvantageous with respect to the uniformity of the filling height. Moreover, the arrangement of the liquid valve must be adapted to the remaining space whereby problems occur with respect to the filling operation affecting a reduction in and the quality of the filling material and the filling speed.

SUMMARY OF THE INVENTION

Therefore, it is the primary object of the present invention starting with such a filling valve, apart from the savings involved in avoiding the use of apparatus for lifting the bottles against a stationary filling valve, to provide a filling valve arrangement such that when the valve is opened there is perfect equalization pressure between the filling machine vessel and the container being filled. After the container is filled, while a centering member of the arrangement is still pressed against the container opening, the return gas tube can be emptied and pressure relief can be established without any flow of ambient air through the container opening. Furthermore, the usual expansion below the liquid surface in the container is avoided. In addition, a filling arrangement is afforded which has different variations with respect to the application or pressure conditions.

In accordance with the present invention, a filling valve of the type mentioned above includes a centering member containing the filling valve and arranged so that it can be lowered by a cam disc and a pressure spring and/or aided by the overpressure within the vessel so that after displacement by the cam disc, the centering member can be pressed against the container opening independently of the cam disc and only by the spring pressure and/or assisted by the pressure within the vessel with a piston member enclosing the return gas tube arranged to move independently of the movement of the centering member so that during its movement it displaces the filling valve into the open condition with the complete pressure equalization taking place. The opening of the valve is effected by the contact of the piston member with the lever arm. The filling process ends in a known manner when the liquid reaches the lower end of the return gas tube and the filling valve is closed when the piston member is lifted by the cam disc. When the filling valve is closed, simultaneously a volume increase communicating with the container is established while the centering member is pressed against the container, affording an emptying of the return gas tube into the container and with a shutoff of the return gas connection with the vessel, the pressure is relieved to atmospheric pressure.

In the embodiment incorporating the present invention, the filling valve is opened only after a complete pressure equalization between the filling vessel and the container or bottle is establshed, so that a sudden rush of the liquid due to differential pressure between the two containers does not take place. In addition to the emptying of the return gas tube, a pressure release in the container can be effected while the centering member is still pressed against it so that there is no problem of flow of the outside or atmospheric air into the container opening when the return gas tube is withdrawn. In this embodiment the usual expansion of the liquid remaining in the return gas tube below the surface of the liquid is avoided. After closing the preliminary air valve, which can be effected after the termination of the filling process, a partial relief of the container or bottle to a volume increase is obtained by the upward movement of the return air tube due to the corresponding movement of the piston member connected to it. Moreover, in this filling valve vacuum control can be obtained due to the specific arrangement of the centering member in connection with the pressure member, so that, if a bottle is missing or breaks, no vacuum is drawn and an advantageous effect on the overall energy balance is achieved.

Furthermore, another feature of the invention is that the filling valve is displaced into the closed position aided by a pressure spring.

In the present invention, the filling valve is supported on the return gas tube so that it can be displaced in the axial direction and placed in the open condition by a double arm lever with one arm engaging the filling valve and with the other lever arm actuated by the piston member. With this arrangement, there is the previously mentioned advantage that the filling liquid runs into the bottle or container located below the filling valve only after complete pressure equalization between the filling machine vessel and the bottle or container is established.

Further, it is proposed that the piston member is connected with the return gas tube whereby when the return gas tube is removed from the container opening, a volume increase in the space of the liquid level in the container occurs and the liquid which has risen in the return gas tube can flow into the container while maintaining equal pressure between the vessel and the container. Accordingly, the piston member connected with the return gas tube affords a partial release with the flow of liquid out of the return gas tube when the return gas tube is removed from the container or bottle. As soon as the return air valve is closed, the volume is increased further by the removal of the piston member and the pressure within the container automatically drops until atmospheric pressure is present in the system with the container still pressed against the centering member. Through this especially advantageous feature, outside air cannot be drawn into the opening in the container or bottle by the removal of the return gas tube or by the release of pressure, which could be particularly dangerous in the case of oxygen-sensitive beverages, with the container being sealed immediately after the filling operation.

A particularly appropriate control of the preliminary air valve and the return air valve is obtained by-employing a slide valve supported to be displaced parallel to the axis of the filling valve. As a result, it is possible to afford control at different altitudes and at the same time to adapt to the pressure conditions.

Another feature of the invention is that the return gas tube is located within a piston cylinder unit including the piston member and divides the space within the cylinder with a portion of the space acting as a pressure space for moving the return gas tube and another part of the space serving for the introduction of differential pressure.

In accordance with the present invention, the filling valve support body can be lowered onto the container or bottle using the pressure existing in the filling machine vessel so that the second part of the space serves to build up appropriate counterpressure conditions from a separate vessel whereby the pressing forces can be adapted to the container or bottle which possibly could be easily deformed, with the pressing force adapted to the containers in an optimum manner.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
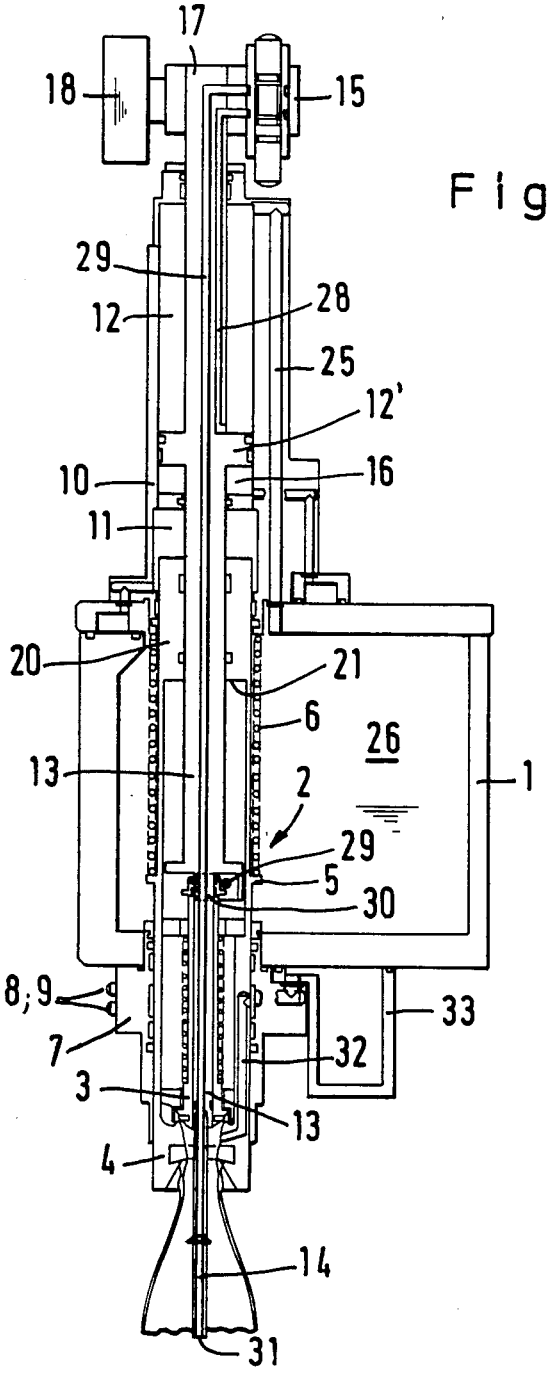
FIG. 1 is an elevational view of a filling valve embodying the present invention and shown in the filling or centering position.

In the drawing the filling valve is used with a reusable bottle as the container. It is possible, however, to fill other containers with such a filling valve without making any changes. In particular, easily deformed containers can be filled because of the differential pressure conditions involved.

As shown in the drawing, the filling valve is partially contained in a filling machine vessel. It is also possible to change this arrangement with the filling valve positioned externally of the filling machine vessel.

Figure 2:
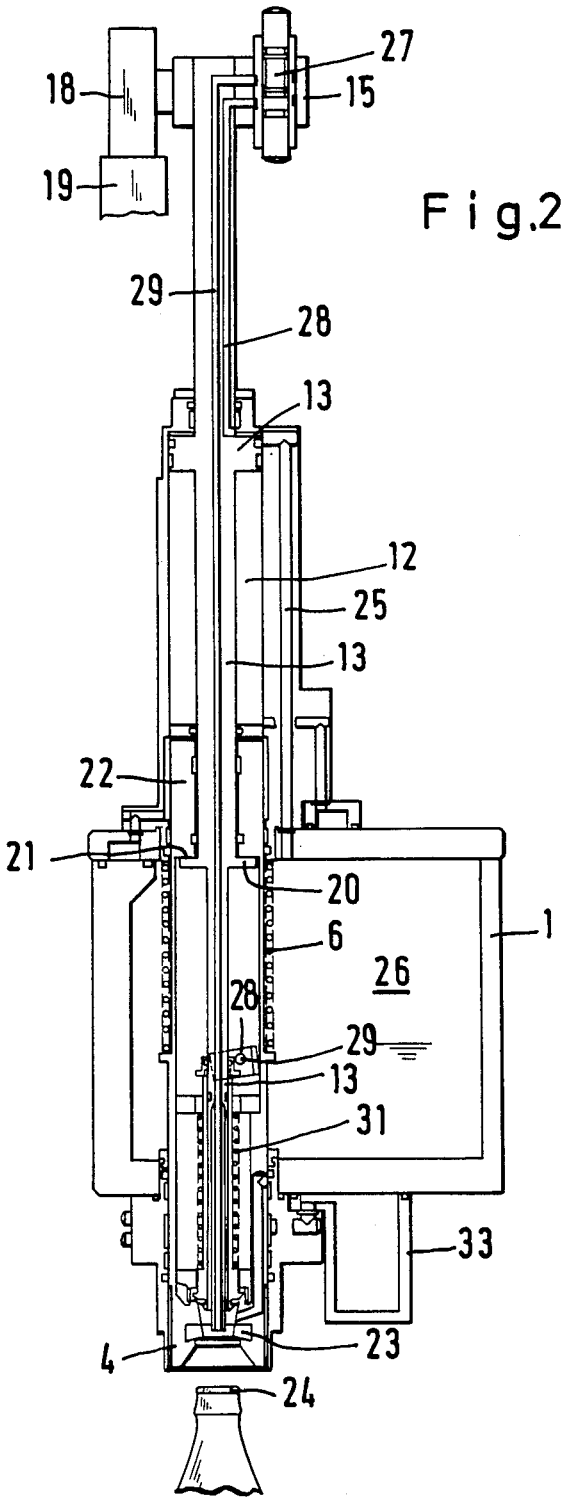
FIG. 2 is a view similar to FIG. 1, however, illustrating the valve in the release position.

In FIGS. 1 and 2 the filling machine vessel 1 has the filling valve 2 located partially within the vessel. A liquid valve 3 forming part of the filling valve is positioned within a vertically displaceable bottle centering member 4. The centering member extends upwardly into the lower end of the vessel 1 and continues up through the vessel and has an outwardly extending projection 5 for receiving the lower end of a pressure spring 6. At its upper end, the spring 6 abuts against the inside wall at the top of the vessel. Below the vessel 1, the centering member 4 is mounted in a support part 7 in which valves 8, 9 are positioned for controlling a vacuum and for rinsing valves or the like. Above the vessel, the centering member is located in a cylinder 10 forming part of a piston-cylinder unit. The cylinder is divided into two main chambers 11 and 12.

As mentioned above, the liquid valve 3 is located at the lower end of the vertically extending centering member 4. A return gas tube piston member 13 extends through the liquid valve 3 and at its lower end the piston member encloses the lower end of a return gas tube 14 which extends upwardly through the vessel into the cylinder 10. The piston member 13 has its upper end extending into the cylinder 10 with a control unit 15 for preliminary air and return air connected to its upper end. In the region of the main chamber 12 within the cylinder 10, piston member 13 forms a separate piston 12' dividing the main chamber to form an additional chamber 16. At its upper end, piston member 13 has a section 17 on which a cam roller 18 is mounted. A cam disc 19, illustrated in FIG. 2 but not shown in FIG. 1, contacts the cam disc and provides the axial movement of the piston member 13 and the enclosed return gas tube 14, In FIG. 2 the filling valve is located in the position immediately after the bottle has been placed on the filling machine. As soon as the centering member 4 is moved downwardly from the position in FIG. 2 to that in FIG. 1, the filling process is initiated. The downward movement of the centering member is effected by the pressure spring 6 along with the piston member 13 which includes a projection 20 at the lower end face 21 of the section 22 of the centering member 4. The downward movement takes place relatively rapidly until the seal 23 at the lower end of the centering member rests against the bottle mouth or opening 24. The centering member 4 is prevented from any further downward movement. The main chamber 12 in the cylinder 10 is connected directly with the space 26 within the vessel 1 by a line 25 so that the overpressure within the vessel is transmitted to the main chamber 12 and moves the piston member 13 further in the downward direction. At this point the preliminary air valve 27 at the control unit 15 is opened with the preliminary air reaching the return gas tube 14 through lines 28', 29' for pressurizing the bottle and effecting pressure equalization in the bottle. As soon as pressure equalization is achieved, the projection 20 on the piston member 13 engages a rocking lever arm 28 movable downwardly around a pivot 29 with the opposite lever arm 30 of the double lever arm releasing the liquid valve 3 and placing it in the open condition so that liquid can flow from the vessel into the bottle. The liquid flow takes place, due to the arrangement of the present invention, practically at constant pressure conditions so that an easy and satisfactory flow of the liquid takes place. As soon as the liquid rises in the bottle and reaches the lower end 31 of the return gas tube 14 no further gas exchange can occur and, therefore, no further fluid can flow into the bottle. At this point, the return air tube 14 along with the piston member 13 are displaced upwardly by the cam disc 19 releasing contact with the lever arm 28 so that the liquid valve closes automatically under the action of a pressure spring 31'. With further upward movement of the pressure member 13, a volume increase is provided in the region of the liquid valve so that the liquid which has risen in the return gas tube 14 flows into the bottle. During additional upward movement of the piston member 13 an additional volume increase takes place in the space above the liquid within the bottle and with the preliminary air valve and return air valve 27 closed there is a corresponding pressure reduction in the overpressure existing in the filling operation with pressure relief in the bottle which is still pressed against the centering member 4.

As soon as the projection 20 reaches the lower face 21 of the section 22 of the centering member 4, it is returned to its original position shown in FIG. 2 and the centering member is lifted off the mouth of the bottle. The bottle can then be moved out of the filling machine and sealed.

As mentioned above, the cylinder is subdivided into a main chamber 11, another main chamber 12 and the additional chamber 16. The main chamber 11 permits the pressure present in the filling machine vessel 1 to act upon the centering member 4. The pressing force can be varied by differing the cross-sectional arrangement of the parts.

The additional chamber 16 is located in the lower part of the main chamber 12 separated by the piston 12' and the additional chamber can, if desired, receive an additional pressure source as a back pressure source, so that the pressing force affording the downward movement of the piston member 13 can be varied.

In the support part 7 various valves for vacuum and rinsing processes are arranged as has been mentioned above. When evacuation of the bottle is desired prior to the actual filling operation, the connection to the vacuum channel 33 can be carried out via a line 32 by the appropriate opening of the vacuum valve 8. It is also possible to provide a prerinsing of the bottles with $CO_2$ or another inert gas alternating with the evacuation step.

While specific embodiments of the invention have been shown and described in detail to illustrate the application of the inventive principles, it will be understood that the invention may be embodied otherwise without departing from such principles.

We claim:

1. Filling machine for filling liquid into a container under counterpressure comprising a filling machine vessel, a filling valve in communication with said vessel, said filling valve including a support body, an upwardly extending return gas tube located in and extending through said support body and having a lower end, valve means in said support body, an upwardly extending piston-cylinder unit for operating said filling valve and with said unit extending through said support body, wherein the improvement comprises a generally vertically movable container centering member displaceable between an upper release position spaced from the container to be filled and a lower centering position engaging the container to be filled with said filling valve extending from said vessel to said centering member, means for moving said centering member between the release position and the centering position and for moving the lower end of said return gas tube into the container to be filled downwardly from said centering member, a piston member in said piston-cylinder unit enclosing said return gas tube and displaceable relative to said return gas tube in the centering position of said centering member for opening said filling valve for supplying liquid from said filling machine vessel, said means for moving said centering member arranged to close said filling valve by lifting said piston member when the liquid introduced from said pressure vessel through said filling. valve into the container reaches the level of the lower end of said return gas tube while said centering member remains in the centering position, so that by lifting said piston member an increased volume communicating with the container is established and the return gas tube empties the liquid therein into the container and, with the shutoff of the return gas connection to said vessel, a pressure release of the space within the container to atmospheric pressure takes place.

2. Filling machine, as set forth in claim 1, includes a pressure spring for placing the filling valve in the open condition.

3. Filling machine, as set forth in claim 1, wherein said filling valve is supported on said return gas tube and is displaceable in the axial direction of said tube, a double arm lever located within said piston cylinder unit and in operative engagement with said filling valve, said piston member being displaceable into engagement with one said lever arm and displacing it so that the other said lever arm opens said filling valve.

4. Filling machine, as set forth in claim 1, wherein said piston member is connected with said return gas tube so that when the return gas tube is removed out of the bottle a volume increase is established within said centering member above the bottle in communication with the liquid level in the bottle whereby liquid which has risen in the return gas tube flows into the bottle while maintaining the same pressure within said filling machine vessel and the bottle.

5. Filling machine, as set forth in claim 1, wherein a preliminary air valve and a return air valve designed as a slide valve is supported adjacent the upper end of said return gas tube and is displaceable parallel to the axis of said filling valve.

6. Filling machine, as set forth in claim 1, wherein said piston cylinder unit is divided into an upper main space and a lower main space, said return gas tube extends upwardly from said centering member through said piston-cylinder unit through said upper main space, said piston member includes a piston located within said upper main space, and said upper main space is arranged as a pressure space for axial displacement of said return gas tube, and said piston divides said upper main space into a lower additional space for providing differential pressure within said filling machine.

7. Filling machine, as set forth in claim 1, wherein said valve means in said support body provides control for preliminary air, return air and a vacuum associated with said filling valve.

8. Filling machine, as set forth in claim 1, wherein said means for moving said centering member includes a cam roller located at the upper end of said piston-cylinder unit and a cam disc engageable with said cam roller for effecting axial movement of said piston member.

* * * * *